US006186136B1

(12) United States Patent
Osborne

(10) Patent No.: US 6,186,136 B1
(45) Date of Patent: Feb. 13, 2001

(54) STRETCH REDUCTION SYSTEM FOR CONCRETE CUTTING CHAIN SAW

(75) Inventor: Ian S. Osborne, Hillsboro, OR (US)

(73) Assignee: Blount, Inc., Portland, OR (US)

( * ) Notice: Under 35 U.S.C. 154(b), the term of this patent shall be extended for 0 days.

(21) Appl. No.: 09/459,424

(22) Filed: Dec. 13, 1999

(51) Int. Cl.[7] ..... B28D 1/08

(52) U.S. Cl. ..... 125/21; 451/444; 451/453; 451/298

(58) Field of Search ..... 125/21, 12; 451/444, 451/451, 453, 455, 298, 355; 198/846; 30/381; 83/830, 832

(56) References Cited

U.S. PATENT DOCUMENTS 3,593,700 * 7/1971 McNulty ..... 125/21
4,920,947 * 5/1990 Scott et al. ..... 125/21
5,184,598 * 2/1993 Bell ..... 125/21
5,215,072 * 6/1993 Scott ..... 125/21
5,603,311 * 2/1997 Hoerner et al. ..... 125/21
5,918,586 * 7/1999 Von Dungen et al. ..... 125/21

FOREIGN PATENT DOCUMENTS

3413513 * 3/1985 (DE) ..... 125/21

* cited by examiner

*Primary Examiner*—Eileen P. Morgan
(74) *Attorney, Agent, or Firm*—Robert L. Harrington

(57) ABSTRACT

A chain saw for aggregate material has a nozzle that provides a spray of water to that portion of the saw chain that is traveling between the guide bar and the drive sprocket. The flooding provided by the nozzle washes slurry off of the saw chain. A basin with inclined baffles is provided to collect the slurry carried by the saw chain into the housing. Apertures are provided in the basin for discharging the collected slurry.

8 Claims, 4 Drawing Sheets

STRETCH REDUCTION SYSTEM FOR CONCRETE CUTTING CHAIN SAW

FIELD OF THE INVENTION

This invention relates to chain saws used for cutting concrete and more particularly to a system for removing expended slurry from the cutting components.

BACKGROUND OF THE INVENTION

Concrete cutting chain saws are basically structured like conventional chain saws in that a power head drives a sprocket, a bar is mounted to the power head in alignment with the sprocket, and a loop of cutting chain is entrained around the bar and sprocket to be rapidly driven by the sprocket in a circuitous path. Projecting teeth from the saw chain sequentially bite into a surface being cut, each removing small bits of material and collectively cutting a kerf through the material.

The chain consists of numerous individual parts including cutting teeth, side links and center links primarily made of steel and in the case of a concrete saw, the teeth of the cutters have embedded diamond bits. Whereas wood products i.e., trees, are commonly cut with chain saws with a chain lasting for many hours, days and weeks of cutting, as concerns concrete cutting, the cutting chain rapidly wears and has to be frequently replaced at great expense.

A known cause of this rapid wearing is the presence of concrete dust or small particles of concrete that are immersed in water and which form a slurry. The particles in the slurry become injected into the bearing surface areas of the chain. A saw chain is made of many individual links that are interconnected for relative pivoting. Holes formed in the links are aligned fore and aft with holes in preceding and succeeding links, and pins or rivets projected through the holes connect the links together so as to allow relative pivoting. This pivotal action which occurs continuously as the chain is driven around the sprocket and bar produces surface to surface rubbing as between the rivets and the rivet holes for example. Due to the concrete particles being injected between these surfaces, the wearing of the surfaces increases significantly and this wearing induces stretching of the chain as the holes are enlarged. The chain needs to be taut and as it stretches, the chain mount has to be adjusted and such is time consuming. Eventually the chain stretches to a point where it no longer meshes with the drive sprocket and has to be replaced. This often occurs prior to total wearing of the cutting teeth which is normally expected to determine end of life.

It is an object of the present invention to reduce the rate of wearing caused by concrete slurry being injected into the saw chain pivotal joints.

BRIEF SUMMARY OF THE INVENTION

Studies were conducted and it was determined that significant amounts of the slurry are carried by the rapidly running chain as the chain enters the housing of the drive sprocket end of the bar. It is theorized that this housing or enclosure entraps the slurry and the chain functions like an impeller to carry the slurry into and through the housing at the rear end of the bar where the slurry becomes concentrated. Because the chain is forced to pass through the area of concentration, the slurry has a greater propensity to penetrate into the pivotal joints with the undesired wearing being a result.

Prior to this invention the housing portion enclosing the drive sprocket and bar end (sometimes referred to as a cowel or cowling) was slotted below the sprocket with the idea that the slurry would, by gravity action, be directed down through the slots. The amount of slurry falling away from the chain and down through the slots was minimal and the present invention is directed to an alternative solution to the problem.

It is theorized that the flow of slurry follows the path of the chain and is somewhat tumultuous as the various forces act to direct the slurry in a cicuratious path around the drive sprocket. Least of these is gravity force which is greatly exceeded by the force of momentum and centrifugal force, and thus there is little chance for the slurry to fall down through the slots.

In the preferred embodiment of the invention, a diverter in the form of barriers or deflectors, e.g., baffles, are placed in the flow path of the slurry. These deflectors (baffles) are placed in the cowel or as part of the cowel in the area whereat the chain enters the drive sprocket. Preferably they are located in the area where the chain travels around the sprocket and particulary within the 90 degree turn where the chain is being reversed, i.e., at the rearmost point of travel. The baffles are positioned in close proximity to the travel path of the saw chain as it travels around the sprocket and preferably they are oriented radially with respect to the sprocket. In this orientation, the slurry impacts and is deflected off the baffles toward the bottom of the cowling.

The baffles are enclosed by the cowling to form a catch basin and the basin is provided with a drain hole or holes. As the slurry flows into the cowel and as the chain starts its turn around the sprocket, the slurry flows against the baffles and is diverted by the baffles into the basin whereat the slurry settles and flows down through the drain holes.

As a second part of the invention, just prior to the saw chain entering onto the drive sprocket, a water nozzle is provided on the housing at a position that is at the inner side of the chain (inside the chain loop), the nozzle being directed, inside to outside through the chain. Water forced through the nozzle flushes slurry from the chain and into the path of the slurry being otherwise propelled by the chain teeth where it will engage and be deflected by the baffles, thus cleansing the chain before the joints start to articulate as required to change direction from straight line travel to curved travel and back to straight line travel at the top of the sprocket.

The combination of the flushing nozzle and flow-deflecting baffles produces substantially increased removal of the slurry. Tests have been conducted and the removal of the slurry has improved the wearability of the chain pivotal joints achieving as much or more than 30% increased life. Furthermore, it has been found that the life of the cutting teeth is increased which is believed due to the additional flushing or cleansing of the teeth by the above added water nozzle.

The invention and the benefits therefrom will be more fully understood and appreciated with reference to the following detailed description and drawings referred to therein.

DESCRIPTION OF THE PREFERRED EMBODIMENT

Figure 1:
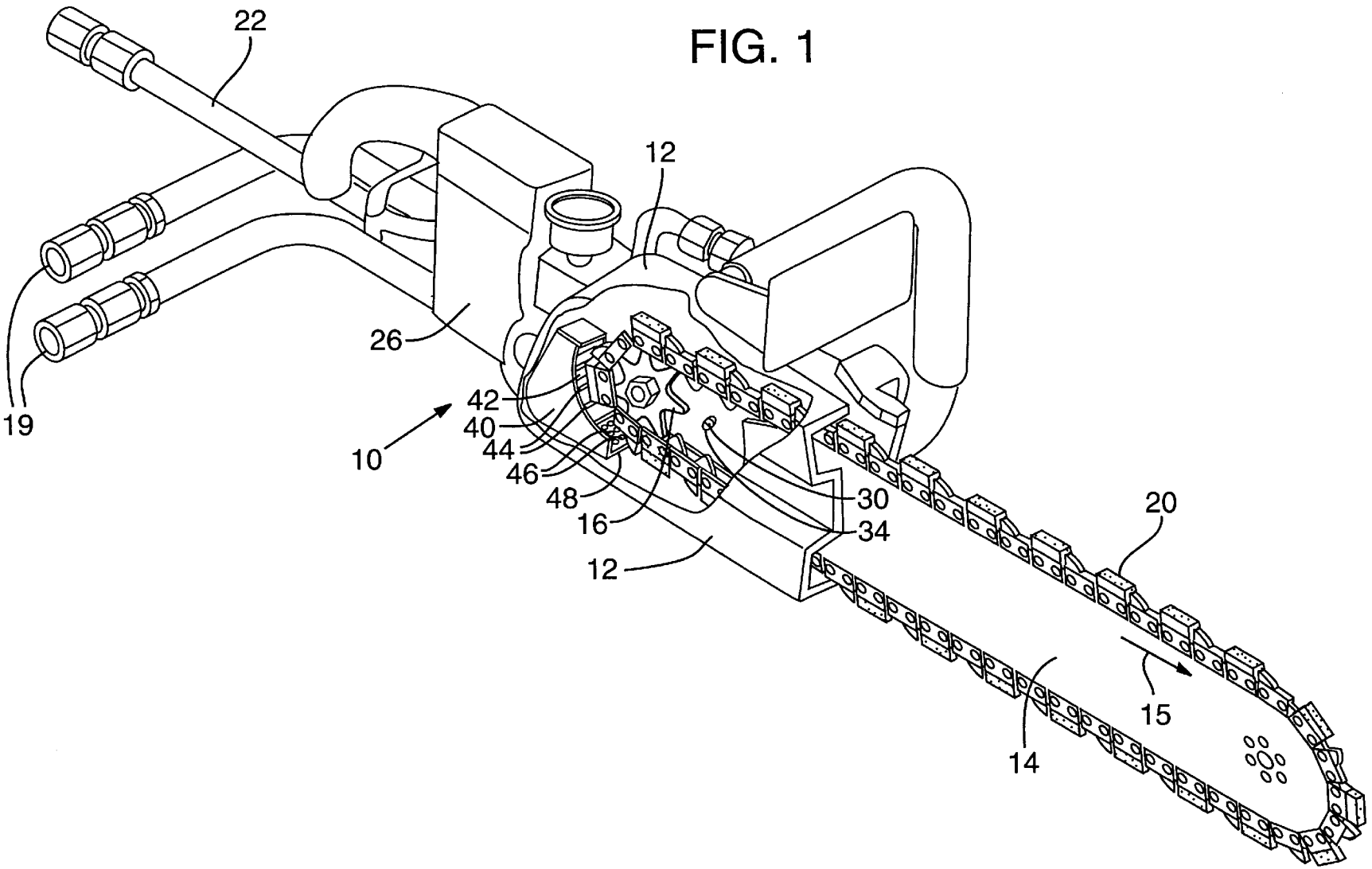
FIG. 1 is a perspective view of a concrete cutting chain saw.
Figure 2:
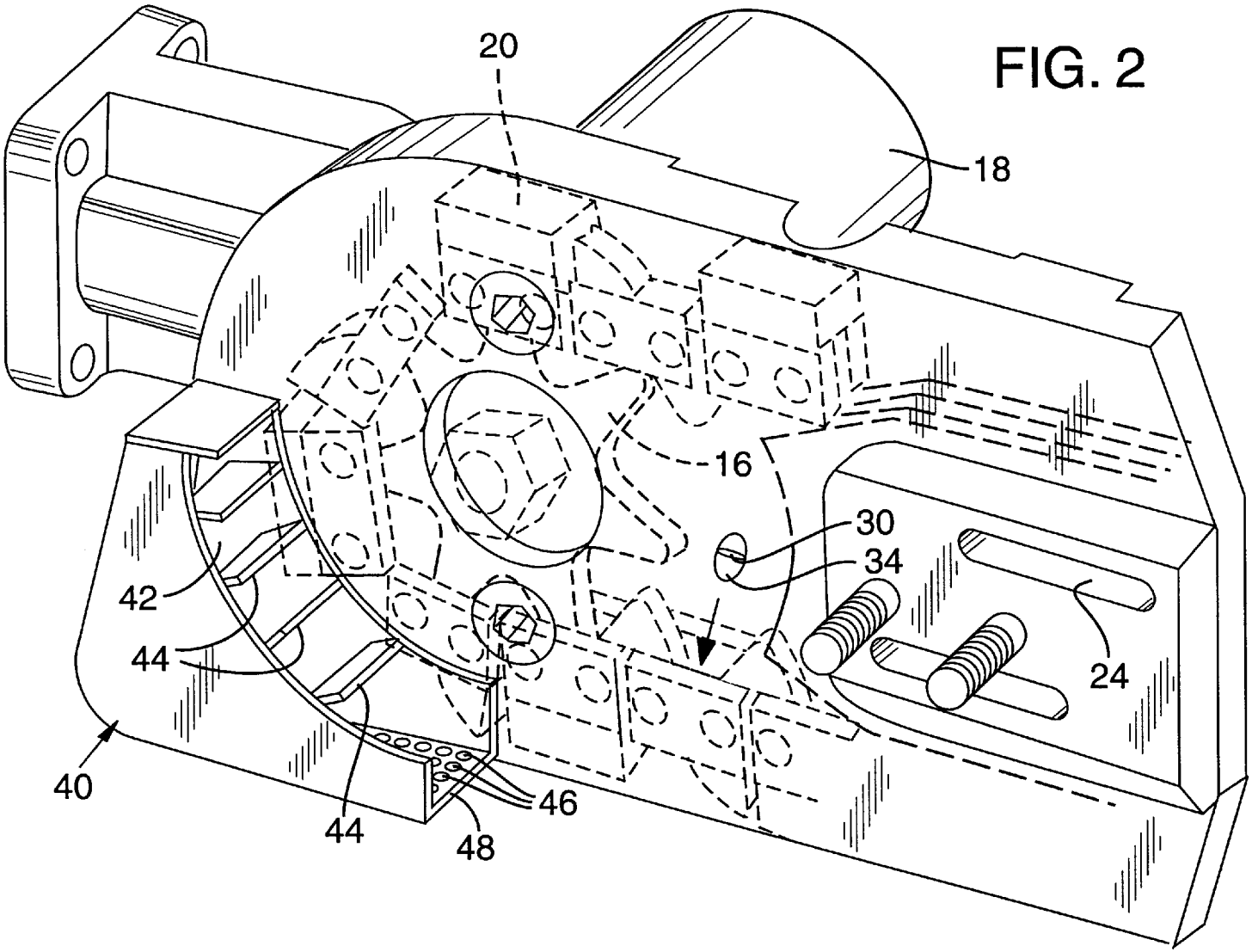
FIG. 2 is a partial perspective view of the chain saw of FIG. 1 illustrating the saw chain in phantom lines.
Figure 5:
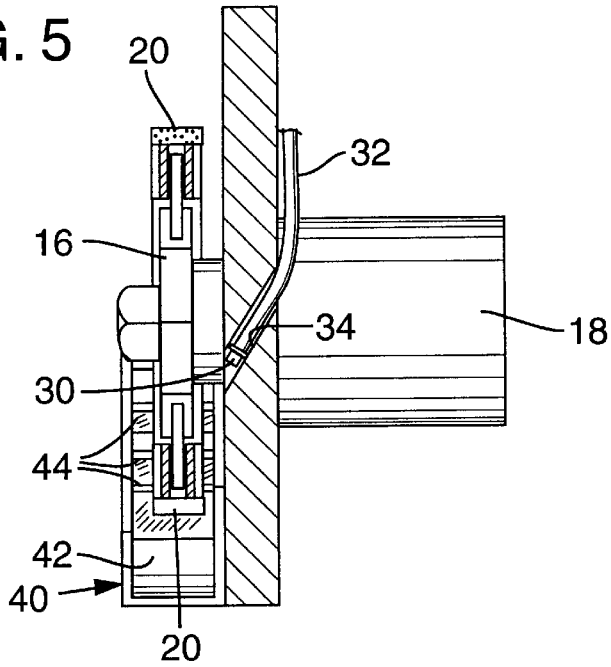
FIG. 5 is a view as viewed on view lines 5—5 of FIG. 3.

FIG. 1 illustrates a chain saw 10 suited for cutting aggregate material such as concrete and the like. The saw 10 has a power head 12 which supports a guide bar 14. A drive sprocket 16 is aligned with the guide bar 14. The sprocket 16 is rotatably driven by a drive motor 18 (see FIGS. 2 and 5). A saw chain 20 is entrained around the guide bar 14 and the drive sprocket 16. Rotation of the drive sprocket 16 drives the saw chain 20 around the guide bar 14 in the direction indicated by arrow 15.

In this embodiment the drive motor 18 is of the hydraulic type and power is supplied to the drive motor 18 by hoses 19. The hoses 19 are connectable to a known power source.

Figure 3:
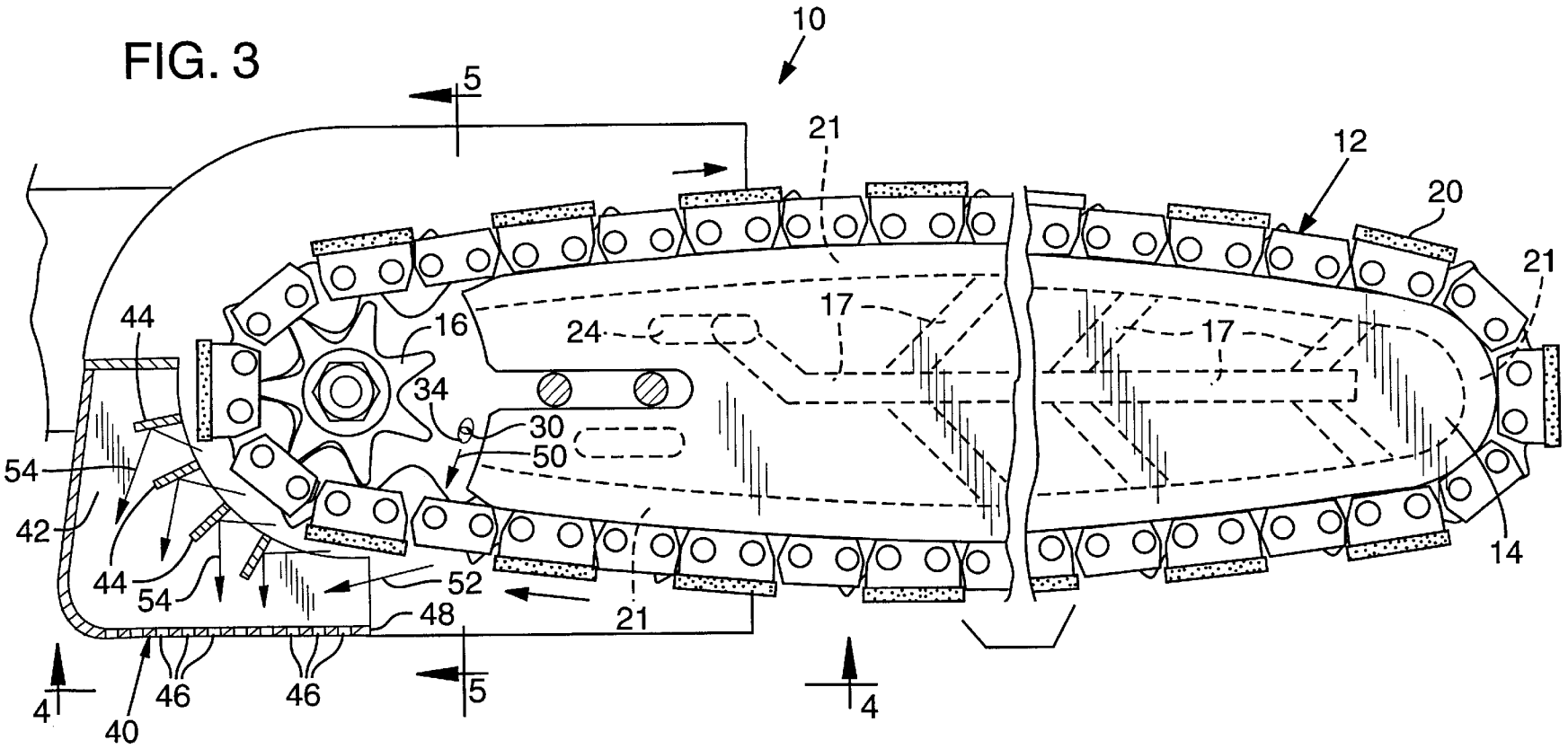
FIG. 3 is a side view of the chain saw of FIG. 1.
Figure 4:
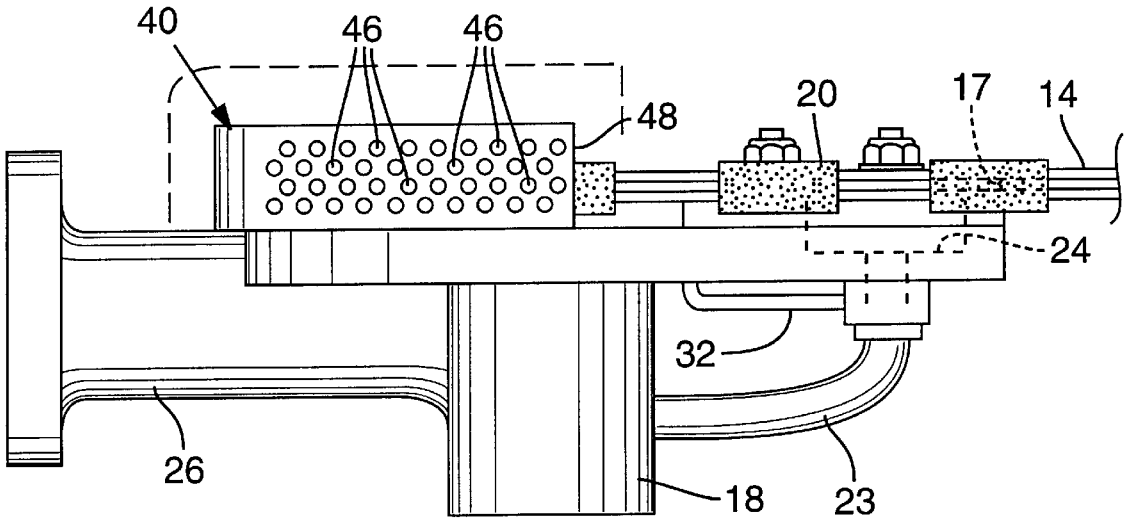
FIG. 4 is a view as viewed on view lines 4—4 of FIG. 3.

Typically the guide bar 14 has internal channels 17 (FIG. 3) for directing a flow of water to the saw chain 20. A hose 22 extends from a valve body 26 and is connected to a known water source. A hose 23 extends from the valve body 26 as seen in FIG. 4 and is coupled to a slot 24 of the power head 12 to deliver water to the guide bar 14 (see also FIGS. 2 and 3). Water is delivered through the slot 24 of the power head 12 to the internal channels 17 of the guide bar 14. The water flows through the channels 17 of the guide bar 14 and exits in the guide groove 21 of the bar to flood the saw chain 20.

The water flooding the saw chain 20 combines with the fine particulates produced by the saw chain 20 as it cuts the aggregate material. This combination of the water and particulates forms a slurry that is very abrasive and if not removed from the saw chain and guide bar accelerates the wearing of the components of the saw chain and the guide bar. Further, the saw chain 20 as it travels around the guide bar 14 acts as a carrier or impeller to propel the slurry along the saw chain and around the guide bar. It is desirable to remove this slurry and thereby reduce the wear factor created by the slurry.

In this embodiment an additional spray of water is directed at the saw chain as it enters the housing to aid in removing the slurry from between the saw chain parts. As seen in the various views of the figures, a nozzle 30 mounted on an end of a tube 32 is positioned strategic to the saw chain 20 and is preferably near the point at which the saw chain 20 is engaged by the sprocket 16 (See FIG. 2). The tube 32 is extended through a slot 34 in the housing of the power head 12. The tube 32 is connected to the water supply hose 23 that is coupled to the slot 24.

A basin 40 is mounted to the power head in close proximity to the drive sprocket 16 and is aligned with the travel path of the saw chain 20. The basin 40 provides a chamber for collecting and discharging the slurry being discharged from the saw chain 20. As previously mentioned, it is theorized that the motion of the saw chain 20 drags slurry through the kerf being cut and propels it into the housing of the power head 12. The basin 40 in the housing has an open side 42 positioned adjacent the drive sprocket 16 and the saw chain 20 entrained thereon. Baffles 44 are provided on the open side 42 to direct the flow of slurry into the chamber of the basin 40. The baffles 44 are inclined at an angle to the travel path of the saw chain 20 and preferably substantially radially from the sprocket axis. Multiple holes (apertures) 46 are provided in the base portion of the basin 40 for the discharge of the entrapped slurry and water.

During operation the saw chain 20 is propelled rapidly around the guide bar 14 by the drive sprocket 16. When the saw chain 20 is engaged with material to be cut, water is delivered to the guide bar 14 through the slot 24. The water introduced to the guide bar 14 flows out the guide groove 21 around the saw chain to provide a lubricating fluid as well as a flushing fluid to remove the fine particulates generated by the saw chain 20. The flushing fluid removes most of the fines from the guide groove of the guide bar but the slurry is carried by the chain through the kerf and toward the power head housing.

The nozzle 30 sprays the portion of the saw chain 20 that is traveling between the point where the chain leaves the guide bar and enters the drive sprocket 16 to propel slurry clinging to the chain parts off of the chain 20 as indicated by arrow 50. This slurry component enters the flow of slurry being propelled by the chain through the kerf as indicated by arrow 52. The slurry is then affected by centrifugal force and momentum to engage baffles 44. The baffles 44 of the basin 40 redirect the flow of slurry into the chamber of the basin 40 as indicated by arrows 54. The baffles then provide a form of protection to reduce the turbulence and allow the slurry to settle and flow out of the housing through holes 46.

Those skilled in the art will recognize that modifications and variations may be made without departing from the true spirit and scope of the invention. For example, the objective of the baffles is to interrupt and/or divert the flow of slurry which heretofore first traveled along the straight reach of saw chain due to momentum, and then around the drive sprocket end again following the chain but at least partially due to the curved path defined by the cowling which wraps around the drive sprocket end. Such interruption or diversion is believed optimally achieved by the disclosed baffles. However, other forms of diversion may include the use of a directed air or water spray directed crossway through the flow of slurry and functioning as a diverter. The cowling itself may be configured to produce a desired diversion by avoiding the wrap around configuration which facilitates the impeller action, and instead provide a configuration for channeling of the slurry (diverting) away from the sprocket and chain. Thus, the slurry is propelled rearwardly along a straight path as the chain curves around the sprocket. The invention is therefore not to be limited to the embodiments described and illustrated but is to be determined from the appended claims.

The invention claimed is:

1. A concrete cutting saw comprising;

a power head, a sprocket driven by the power head, a guide bar mounted to the power head and extended from the power head in alignment with the sprocket, and a saw chain looped around the sprocket and guide bar and defining thereby an inner side and an outer side of the saw chain, said saw chain driven by the sprocket and guided by the guide bar in a concrete cutting operation;

a water source provided to flush concrete dust and particles from the guide bar and saw chain during a concrete cutting operation which generates a slurry of water and the concrete particles, a portion thereof being carried by the saw chain towards the sprocket and power head, and an enclosure surrounding the sprocket, and said slurry portion carried by said saw chain into the enclosure and along a path adjacent the saw chain;

said enclosure including a diverter that diverts the slurry away from the path of the chain.

2. A concrete cutting saw as defined in claim 1 wherein the diverter is a baffle positioned in the path of the slurry for diverting the flow of the slurry.

3. A concrete cutting saw as defined in claim 2 wherein the baffle is positioned adjacent the saw chain where mounted on the sprocket and within a quadrant extending between the position of entry of the chain onto the sprocket and the rear most point of the sprocket.

4. A concrete cutting saw as defined in claim 3 including a basin associated with the baffle for collecting the diverted flow of slurry and an opening in the basin for draining the slurry from the basin.

5. A concrete cutting saw as defined in claim 4 including a plurality of baffles substantially oriented radially from the sprocket axis and cooperatively diverting the slurry into the basin.

6. A concrete cutting saw as defined in claim 1 including a water nozzle provided in said power head positioned for spraying water through the saw chain from inner side to outer side thereof and into the path of the slurry as the slurry enters the enclosure.

7. A concrete cutting saw comprising:

a power head, a sprocket driven by the power head, a guide bar mounted to the power head and spaced from and extended from the sprocket, and a saw chain looped around the sprocket and guide bar and defining thereby an inner side and an outer side of the saw chain, said saw chain driven by the sprocket and guided by the guide bar in a concrete cutting operation;

a water source provided to flush concrete particles from the guide bar and saw chain during a concrete cutting operation which generates a slurry of water and concrete particles, a portion thereof being carried by the saw chain toward the sprocket and power head, and an enclosure surrounding the sprocket and said slurry portion carried by said saw chain into the enclosure and along a path adjacent to the saw chain; and a water nozzle positioned in said enclosure for directing a spray of water through the saw chain from the inner side of the chain and toward the outer side of the chain and into the path of the slurry as the slurry enters the enclosure.

8. A concrete cutting saw as defined in claim 7 wherein the water nozzle is positioned inside the loop of chain between the bar and sprocket.

* * * * *